United States Patent [19]

Duke

[11] Patent Number: 4,546,871

[45] Date of Patent: Oct. 15, 1985

[54] GAP MAKER

[75] Inventor: Billy M. Duke, Rouses Point, N.Y.

[73] Assignee: Harris Corporation, Melbourne, Fla.

[21] Appl. No.: 419,775

[22] Filed: Sep. 20, 1982

[51] Int. Cl.[4] ..... B65G 47/29

[52] U.S. Cl. ..... 198/425; 198/461; 271/182; 271/256

[58] Field of Search ..... 198/425, 461, 462; 271/35, 182, 183, 229, 230, 231, 256

[56] References Cited

U.S. PATENT DOCUMENTS

| | | | |
|---|---|---|---|
| 2,889,029 | 6/1959 | Ridenour | 198/462 |
| 3,072,095 | 1/1963 | Kessen et al. | 198/460 X |
| 3,122,230 | 2/1964 | Bogue | 198/462 |
| 3,149,834 | 9/1964 | Faeber | 271/258 |
| 3,313,221 | 4/1967 | Gubeli | 198/503 |
| 3,373,666 | 3/1968 | Crampton | 198/422 |
| 3,403,772 | 10/1968 | Vadas | 198/425 |
| 3,595,138 | 7/1971 | Brockmuller et al. | 198/425 X |
| 3,708,162 | 1/1973 | Skudlarek | 271/256 |
| 3,724,840 | 4/1973 | Kuckhermann | 271/182 X |
| 3,834,288 | 10/1974 | Behrens et al. | 198/425 |
| 4,041,677 | 8/1977 | Reid | 198/425 X |
| 4,266,654 | 5/1981 | Achelpohl et al. | 198/425 |
| 4,456,117 | 6/1984 | Szczepanski | 198/461 |

FOREIGN PATENT DOCUMENTS

| | | | |
|---|---|---|---|
| 442115 | 2/1936 | United Kingdom | 198/462 |

*Primary Examiner*—Joseph E. Valenza
*Assistant Examiner*—Stuart J. Millman
*Attorney, Agent, or Firm*—Yount & Tarolli

[57] ABSTRACT

An apparatus forms a continuous moving stream of signatures into groups separated by gaps. The apparatus includes lugs which travel along a path having an upwardly inclined portion between belts of a conveyor. The lugs lift the signatures off the conveyor while keeping them moving at conveyor speed. Once the signatures are lifted, the lugs stop. The leading signature lifted by a lug is pinched between the lug and biasing members pressing down on the stream of signatures. A guide extends upstream from the biasing members to control stack up of the signatures behind the leading signature. When a sufficient gap has been formed, the lugs accelerate and lower the signatures back onto the conveyor.

13 Claims, 5 Drawing Figures

GAP MAKER

BACKGROUND OF THE INVENTION

The present invention relates to an apparatus for making a gap in a moving stream of overlapped signatures.

In the printing industry there is a need to form gaps in streams of overlapped signatures moving on conveyors. For example, signatures from a printing press or folder travel in an overlapped or shingled stream. In order to stack or bundle the signatures in groups of a predetermined size it is desirable to make a gap in the moving stream.

Various stream interrupters or gap makers have been used in the past. Most of these gap makers temporarily arrest some of the signatures while those signatures ahead continue to advance. Once the gap is formed, the temporarily halted signatures are released, and they again move with the conveyor. The stream of signatures may be stopped by abruptly interposing a finger or the like to stop the stream. Devices of this sort are shown in U.S. Pat. Nos. 3,373,666 and 3,313,221. Other stream interrupters pinch the signatures between a rail or rails fixed above the conveyor and a rail or rails which move(s) upward from below the conveyor. See, e.g., U.S. Pat. Nos. 3,708,162 and 3,149,834. U.S. Pat. No. 3,724,840 shows a stream interrupter having both features. Once a gap is made in the stream, the signatures are released onto the conveyor.

The prior art stream interrupters or gap makers have a tendency to mutilate the lead signature of a group when that signature is stopped and then released onto the conveyor. Specifically, when a signature at the front of a group is temporarily stopped, the rear edge of that signature may be curled under because of contact with the moving conveyor. Further, the outside page of the front signature of a stopped group may be stripped from the signature when it is released back onto the moving conveyor. Moreover, in many of these gap makers the pressure applied to the leading signatures of a group to stop them is uneven across the width of the conveyor. Since the conveyor continues to move and therefore pulls on the trailing edges of the stopped signatures, especially those at the front of a group, there is a tendency to skew the leading signatures of a group.

SUMMARY OF THE INVENTION

The present invention overcomes the aforementioned difficulties with prior gap makers.

The present invention first lifts the signatures to be stopped off the moving conveyor without slowing their movement. This is accomplished by a mechanism which includes a series of signature engaging members on an endless moving member such as a chain whose path moves the signature engaging members upward from below the moving signatures. The chain moves the signature engaging members at the same speed as the conveyor. A pair of coaxial, spaced pressure wheels are disposed above the conveyor and ride on the top of the signature stream. The signature engaging members lift the signatures from the conveyor and continue moving at the speed of the conveyor until the lead signature arrives at the pressure wheels, at which point the chain carrying the signature engaging members stops moving temporarily. The lead signature is held elevated above the moving conveyor between the signature engaging members and the pressure wheels, and of course the succeeding signatures are blocked from movement.

The signature engaging members are wide enough so that the lead signature engaging member pinches the lead signature against the two pressure wheels. An adjustable guide above the conveyor controls the stack up of signatures behind the stopped lead signature.

The signatures on the conveyor in advance of the lead signature, which is stopped, are carried forward by the conveyor to form a gap. Thereafter, the chain and the signature engaging members start moving again, accelerating the signatures to the conveyor speed and gently lowering the signatures back onto the conveyor.

Because the signatures are lifted from the conveyor before being stopped, there is no chance for the moving conveyor to curl the outside page of the stopped lead signature. In addition, because the signature engaging members are relatively wide and pinch the lead signature against a pair of spaced apart wheels, there is little chance of the signatures at the front of the stopped group getting skewed. Accelerating the signatures before lowering them onto the moving conveyor prevents the outermost sheet of the lead signatures from being stripped by the conveyor.

DESCRIPTION OF THE DRAWINGS

The above and other features of the invention will become clear to those skilled in the art to which it relates from the following detailed description made with reference to the accompanying drawings in which.

DESCRIPTION OF PREFERRED EMBODIMENT

The present invention comprises an apparatus 10 (FIG. 1) for forming a continuous, moving stream of overlapped signatures into groups of signatures separated by gaps. The apparatus 10 includes a conveyor 12, a pressure wheel assembly 14, and a mechanism 16 which raises signatures above conveyor 12 and presses at least one signature against the wheel assembly 14. The mechanism 16 and pressure wheel assembly 14 stop the signature stream temporarily so that a gap is formed between the lifted signatures and those ahead of the lifted signatures on the conveyor.

Figure 1:
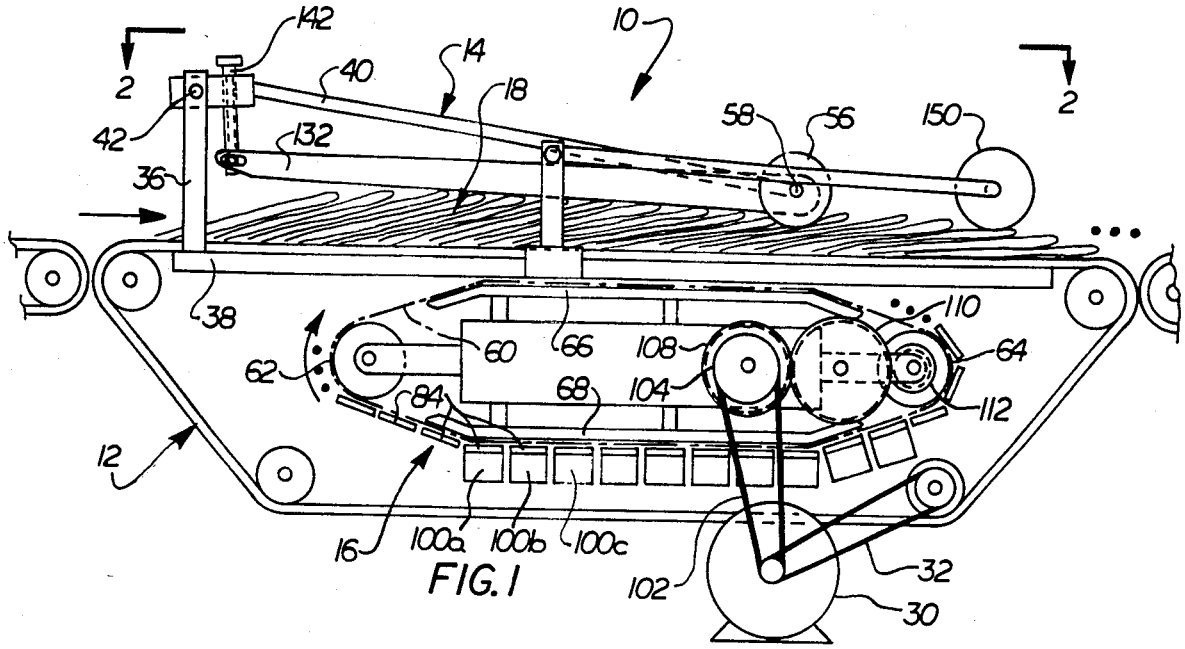
FIG. 1 is a side view of a gap maker constructed according to the present invention.
Figure 2:
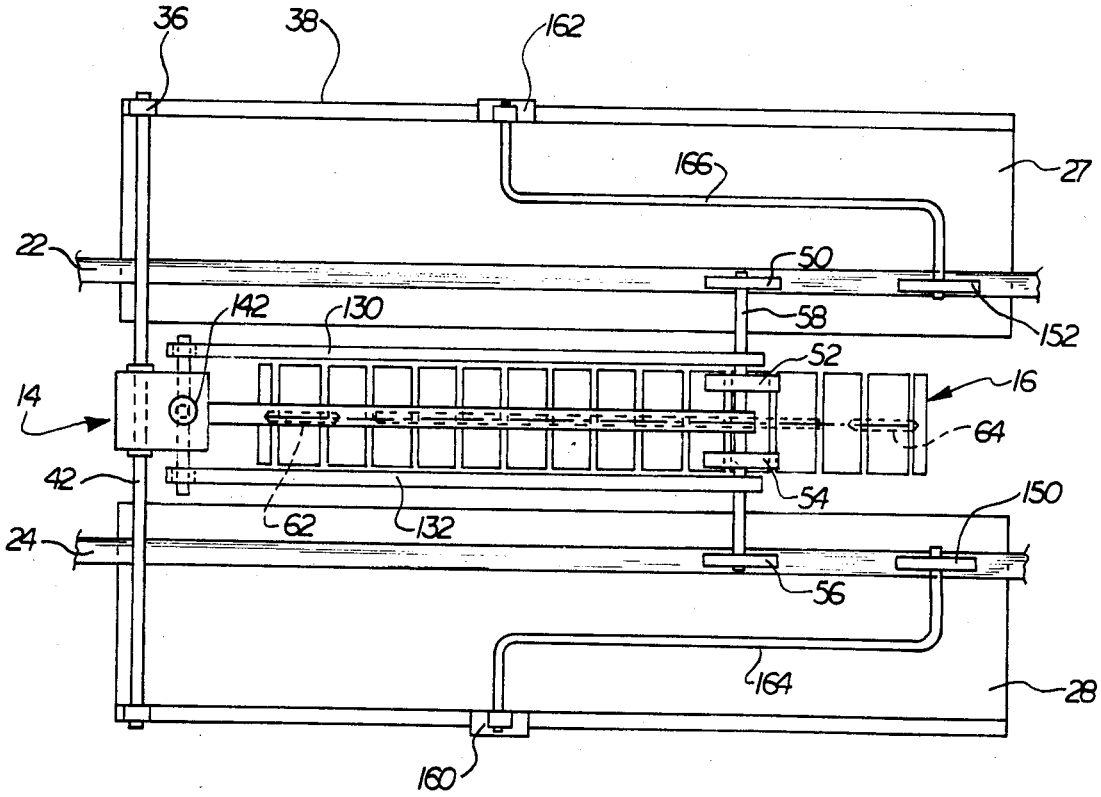
FIG. 2 is a plan view of the gap maker of FIG. 1.

The conveyor 12 includes at least two parallel belts 22, 24 (FIG. 2). Additional belts may be used depending upon signature width. The belts 22, 24 are driven by a motor 30 (FIG. 1) through a drive belt 32, or by any other suitable means. The conveyor 12 carries a stream 18 of overlapping signatures which may be magazines, portions of books, or newspapers. The conveyor 12 further includes a pair of conveyor support plates 27 and 28 (FIG. 2) connected with the frame 38 of the machine. The conveyor belt 22 slides across and is supported by support plate 27 while the conveyor belt 24 is supported by and slides on support plate 28. There is a space between the two support plates 27 and 28 through which portions of the mechanism 16 rise to lift signatures off the conveyor belts 22, 24, as will be described below.

The pressure wheel assembly 14 (FIG. 1) includes a bracket 36 which is fixed to the frame 38 of the apparatus 10 and extends upwardly therefrom. A pivot arm 40 is connected with the bracket 36 and is pivotable about shaft 42 which spans the width of the conveyor 12 parallel to and above the plane of the support plates 27 and 28. At the end of the arm 40 opposite from the shaft 42 are four pressure wheels 50, 52, 54, and 56 (FIG. 2) which bear against the top side of the signature stream 18. The pressure wheels 50–56 turn on shaft 58 which is fixed to the arm 40. The outermost wheels 50 and 56 are disposed in vertical alignment with the pair of conveyor belts 22 and 24, respectively. The inner pair of pressure wheels 52 and 54 are disposed above the space between the conveyor support plates 27 and 28 and are vertically aligned with the mechanism 16.

When a group of signatures is lifted off the conveyor 12 by the mechanism 16 and stopped, the leading signature of the group is pinched against the inner pair of pressure wheels 52 and 54.

The total mass of the pressure wheel assembly 14 imposes a downward force equivalent to five pounds at the point of signature contact with pressure wheels 50, 52, 54 and 56 when the mechanism 16 has not lifted the signatures off conveyor 12. When signatures are lifted, the five pound force is concentrated at wheels 52, 54.

Figure 5:
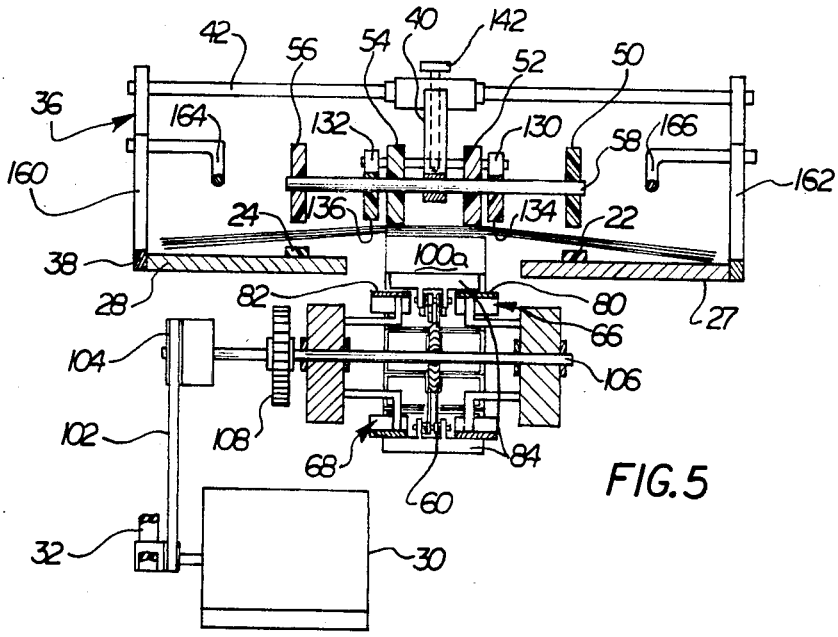
FIG. 5 is a view looking in the direction of arrows 5—5 in FIG. 4.

The mechanism 16 (FIGS. 1 and 5) includes a chain 60 mounted on sprockets 62 and 64. Chain guides 66 and 68 control the path of the chain 60. The chain guide 66 guides the chain 60 along a path which includes a first portion 70 (FIG. 3) which starts at the sprocket 62 and is inclined upward on a gradual slope. The second portion 72 of the chain path is parallel with and below the plane of the support plates 27 and 28. A third portion of the path of the chain 60 is a gradually downward sloping portion 74 which is generally symmetrical with the first portion 70. The portions 70 and 74 form approximately a 10° angle with the second, horizontal portion 72. From the sprocket 64 to the sprocket 62 the chain follows a return path which is a mirror image of its forward, upper path.

The chain guide 66 (FIG. 5) includes a pair of horizontal spaced apart support surfaces 80 and 82. These surfaces are fixed with respect to the conveyor support plates 27 and 28 and are disposed immediately adjacent opposite sides of the conveyor chain 60. The chain 60 carries T-shaped members 84 which have horizontally extending surfaces which ride on the support surfaces 80 and 82. The T-shaped members 84 may be made of a wear resistant material which may be plastic or synthetic and which slides easily over the guide plates 80 and 82.

Some of the T-shaped members 84 (FIG. 4) carry signature engaging members or lugs 100. Preferably there are ten such signature engaging members or lugs **100*a*–100*j* and they are made of urethane. The ten lugs 100*a*–100*j* are connected to adjacent T-shaped chain extensions 84 to form a group covering a continuous portion of the perimeter of the chain 60. The portion of the perimeter equipped with lugs 100 is at least as long as the second section 72 (FIG. 3) of the path of the chain. Depending on the location of the lugs along the path of the chain 60, they can lift a group of signatures off the conveyor 12 and press them against the pressure wheels 52 and 54**.

The chain 60 (FIGS. 1 and 5) and lugs 100 are driven by the motor 30 or such other drive means as is provided to drive the conveyor 12. The motor 30 drives a belt 102 which is connected with a clutch 104. The clutch 104 is carried on a shaft 106 which in turn carries a gear 108. The gear 108 meshes with the gear 110 (FIG. 1) which in turn meshes with a gear 112 which is fixed to the same shaft as sprocket 64. Therefore, when the clutch 104 is engaged, the motor 30 drives the chain 60 in the path defined by the chain guides 66 and 68.

The clutch 104 is a single revolution clutch. When a signal from a controller (not shown) is received by the clutch 104, the clutch is engaged to move the chain, but only for a single revolution of the shaft 106. The chain then automatically stops and will remain stationary until another signal is received by the clutch 104.

The length of the chain 60 and the size of the gears 108, 110, and 112 are selected to define precisely the stopped position of the chain 60 and the lugs 100 thereon. In particular, the chain has one stop position illustrated in FIG. 4 in which the lead lug **100*a* is directly beneath the pressure wheels 52 and 54 and the remaining lugs 100*b*–100*j* occupy the first and second portions 70 and 72 of the path of the chain 60. The chain 60 has a second stopped position illustrated in FIG. 1 in which all the lugs 100*a*–100*j* are located on the return path portion 76 of the chain 60**.

Figure 4:
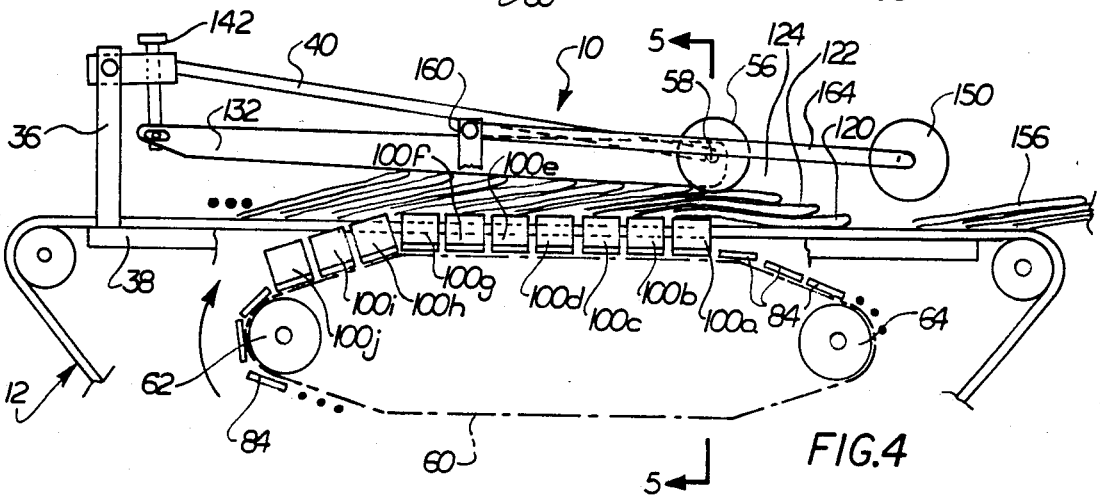

The lugs **100*a*–100*j* extend outward from the path of the chain 60. When the lugs 100*a*–100*j* are in the portion 72 of the path of the chain 60 as illustrated in FIG. 4, the lugs extend vertically above the plane of the conveyor belts 22, 24. Therefore, when the lugs are in this position, they are effective to lift the signatures vertically upward off of the conveyor belts 22, 24**.

Figure 3:
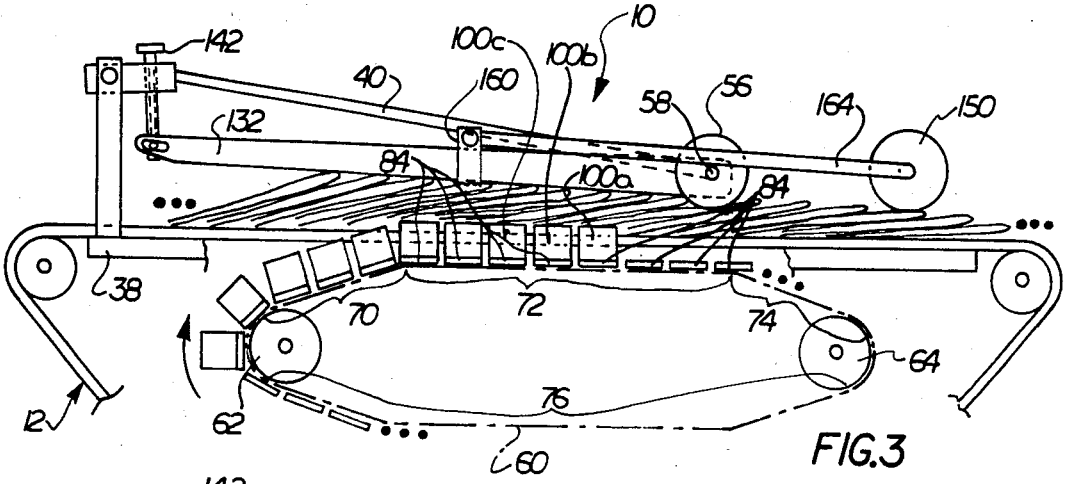
FIGS. 3 and 4 are partial views similar to FIG. 1, but showing the gap maker in a series of operating positions.

Initially, the chain 60 with the lugs **100*a*–100*j* is in the position illustrated in FIG. 1 and the stream of signatures 18 moves across the conveyor 12 uninterruptedly. When a signal is received by the clutch 104 indicating that a gap is to be formed in the stream of signatures 18, the clutch 104 is engaged. This starts the movement of the chain 60 and brings the lugs around onto the first and second portions 70 and 72 of the forward run of the chain 60 as illustrated in FIG. 3. However, as noted above, the clutch 104 is a single revolution clutch, and when actuated it moves the lugs from the position illustrated in FIG. 1 to the position illustrated in FIG. 4 whereupon clutch 104 automatically disengages and the chain 60** stops.

In moving from the position illustrated in FIG. 1 to the position illustrated in FIG. 4, the lugs 100 come around the sprocket 62 and move up the inclined path portion 70. As they move up the inclined chain path portion 70, the lugs **100*a*–100*j* pass upward in the space between the conveyor support plates 27 and 28 and lift the signatures from the conveyor belts 22, 24. This lifting occurs while the chain 60 is moving at the same speed as the conveyor belts 20–26. Therefore, there is no disruption or disarrangement of the stream of signatures 18 as they are lifted from the conveyor 12**.

The lugs **100*a*–100*j* and the pressure wheels 52 and 54 cooperate to hold the temporarily stopped stream of signatures 18 with their leading edges extending transverse to the path of conveyor movement. The lugs 100*a*–100*j* extend in a direction perpendicular to the direction of movement of the conveyor 12 at least as far as the pressure wheels 52 and 54 so that the lead signatures 120, 122, and 124 are pinched between the pressure wheels 52 and 54 and the lug 100*a* at two locations. Thus, any tendency for the signatures to twist is resisted by the contact of the signatures with the lugs 100*a* and the two pressure wheels 52 and 54**.

The apparatus 10 also includes a pair of adjustable guide bars 130 and 132 (FIGS. 2 and 5) which control the stack up of signatures behind the pressure wheels 52 and 54. The adjustable guide bars 130 and 132 extend from the pressure wheels 52 and 54 upstream. Each guide bar 130 and 132 includes a lowermost, signature contacting surface 134 and 136, respectively, which controls the extent of pile-up of signatures when they are lifted off the conveyor belts 20, 24. The guide bars 130 and 132 are pivotable about the shaft 58 on which the pressure wheels 50, 52, 54, and 56 are also mounted. A threaded adjustment shaft 142 is connected with the pressure wheel arm 40 near the shaft 42 on the bracket 36. The angle between the arm 40 and the guide bars 130 and 132 can be varied by turning the adjustment screw 142.

Once the lead signatures, i.e., signatures 120, 122 and 124 are pinched between lug 100*a* and pressure wheels 52 and 54, the following signatures pile up behind and under the control of the guide bars 130 and 132. Lowering the guide bar toward the surface of the conveyor 12 produces a flatter pile up of signatures in which there is a relatively small amount of overlap. Increasing the angle between the conveyor and the guide bars 130 and 132 allows the signatures to overlap more while the lead signatures 120, 122 and 124 are temporarily stopped.

The apparatus 10 includes a third set of pressure wheels 150 and 152 located downstream of the pressure wheels 50, 52, 54 and 56. The pressure wheels 150 and 152 assure that the signature 156 (FIG. 4) which immediately precedes signature 120 is pulled clear of the lug 100*a* and the pressure wheels 52 and 54. The pressure wheels 150 and 152 are vertically aligned with the conveyor belts 22 and 24 and press the signatures, including signature 156 against those belts. When the lug 100*a* presses signatures 120, 122, and 124 against the pressure wheels 52 and 54, signature 156 is pressed by the pressure wheels 150 and 152 against the belts 22 and 24. This assures sufficient friction for the belts 22 and 24 to pull signature 156 out of the grip of lug 100*a* and pressure wheels 52 and 54.

With signatures of different lengths, it is necessary to adjust the axial position of the pressure wheels 150 and 152 so that they press the signature (i.e., signature 156) immediately preceding the first stopped signature (i.e., signature 120). To this end the pressure wheels 150 and 152 are mounted by means of brackets 160 and 162, respectively, which are axially adjustable along the frame 38 of the conveyor 12. Each bracket 160 and 162 carries an arm 164 and 166, respectively, on which the pressure wheels 150 and 152, respectively, are mounted. The arms 164 and 166 are pivotable on their respective brackets 160 and 162 to allow the pressure wheels 150 and 152 to follow the top contour of the signatures 18.

While the lugs 100*a*–100*j*, the pressure wheels 52, 54 and the guide bars 130, 132, cooperate to stop signature 120 and those upstream, signature 156, which is the last signature of the preceding group, continues moving forward on the conveyor 12. This forms the gap between the two groups of signatures on the conveyor 12. Once the gap has been formed, a signal is sent to the clutch 104 that it should engage for another single revolution of the shaft 106. This signal may be sent based on the elapsed time from the previous signal, or it may be sent in response to a gap detector such as a photocell.

When the clutch 104 receives the signal, the stopped signatures are returned to the conveyor 12. The signatures are not merely dropped onto a moving conveyor. This causes stripping of the outside jacket of the lead signature 120 and can also move some of the signatures out of proper alignment. Instead, when the clutch 104 is actuated, the temporarily stopped signatures are accelerated by the lugs 100*a*–100*j* on which they are resting in the direction of movement of the conveyor belts 20–26. Then the signatures are lowered onto the conveyor belts as the lugs 100*a*–100*j* travel down the inclined portion 74 of the path of the conveyor chain 60.

As the signatures are lowered onto the conveyor belts 22, 24, the outside pair of pressure wheels 50 and 56 assist in accelerating the signatures. The outside pressure wheels 50 and 56 are in vertical alignment with the conveyor belts 22 and 24. As the signatures are lowered back on to the conveyor belts 22, 24, the outside pressure wheels 50 and 56 press the signatures against the conveyor belts 22 and 24 to increase the friction therebetween and thus assist in moving the signatures again.

The following is claimed:

1. An apparatus for forming a gap in a signature stream comprising a conveyor for carrying the signature stream, signature engaging means located adjacent said conveyor, and a circulating mechanism for lifting from said conveyor at least one signature which is located a predetermined distance measured in the direction of conveyor movement from said signature engaging means and for moving said one signature at the same speed and in the same direction as said conveyor after said one signature is lifted, for stopping said one signature by stopping said mechanism with a leading portion thereof directly below said signature engaging means so as to pinch said one signature against said signature engaging means while signatures in advance of said one signature continue moving with said conveyor to thereby form a gap in the signature stream, and for thereafter accelerating said one signature back to said same speed and for lowering said one signature back onto said conveyor.

2. An apparatus as set forth in claim 1 wherein said signature engaging means comprises biasing means for resting on the top of the signature stream for pressing the stream against the conveyor.

3. An apparatus as set forth in claim 2 wherein said mechanism includes an endless chain, a series of lugs connected to a continuous portion of the perimeter of said chain and extending outward therefrom, and guide means for guiding the outer surfaces of said lugs along a path having a first upwardly inclined portion which intersects the path of said conveyor, a second intermediate portion parallel to and above the path of said conveyor, a third downwardly inclined portion and a fourth portion connecting said first and third portions, said endless chain being disposed entirely below said conveyor.

4. An apparatus as set forth in claim 3 wherein said signature biasing means includes a first pair of pressure wheels disposed above said conveyor, each of said pressure wheels being rotatable in a plane parallel to the path of said conveyor and biased against the top of said stream.

5. An apparatus as set forth in claim 4 wherein said pressure wheels engage the top of said stream of signatures in said intermediate portion of said path.

6. An apparatus as set forth in claim 4 wherein said mechanism includes drive means for circulating said chain along said path between a first stopped position in which said lugs are disposed along said fourth portion of said path and a second stopped position in which the leading one of said lugs is disposed directly below said first pair of pressure wheels to urge the signature resting on said leading lug upward toward said pressure wheels.

7. An apparatus as set forth in claim 5 wherein said lugs extend laterally in a plane perpendicular to the direction of movement of said conveyor a distance greater than the distance between said first pair of pressure wheels and are positioned so that the signatures on said leading one of said series of lugs are pinched simultaneously against both of said first pair of pressure wheels.

8. An apparatus as set forth in claim 5 wherein said conveyor includes a plurality of parallel belts and said guide means is disposed with said first inclined portion of said path of said lugs between a pair of said belts.

9. An apparatus as set forth in claim 8 further including a second pair of pressure wheels, a single axle mounting said first and second pairs of pressure wheels and a pivot arm mounting said axle for pivoting movement about an axis disposed in a plane perpendicular to the direction of movement of said conveyor, said second pair of pressure wheels each being vertically aligned with a respective one of said belts and pressing said stream of signatures against the respective one of said belts when said drive means has stopped said lugs in said first stopped position.

10. An apparatus as set forth in claim 9 further including a third set of pressure wheels, bracket means for pivotably mounting said third pair of pressure wheels for rolling engagement with the top of said stream of signatures and each of said third pair of pressure wheels being in vertical alignment with one of said belts at a location downstream of said third portion of said path of said chain.

11. An apparatus as set forth in claim 10 including means for adjusting the location along the length of said conveyor at which said third pair of pressure wheels contacts the top of said stream of signatures.

12. An apparatus as set forth in claim 4 further including guide means for limiting upward movement of signatures behind said one stopped signature.

13. An apparatus as set forth in claim 12 including a shaft mounting said first pair of pressure wheels and said guide means includes a guide bar pivotably connected with said shaft and extending parallel to said conveyor in an upstream direction, and means for varying the angle between said guide bar and said conveyor.

* * * * *